United States Patent [19]

Doorenbos

[11] Patent Number: 4,789,087

[45] Date of Patent: Dec. 6, 1988

[54] DEVICE FOR ASSISTING IN PUTTING ON ELASTIC HOSIERY

[76] Inventor: Daryl E. Doorenbos, R.R. 2, Le Mars, Iowa 51031

[21] Appl. No.: 154,659

[22] Filed: Feb. 10, 1988

[51] Int. Cl.[4] ..... A47G 25/90

[52] U.S. Cl. ..... 223/111; 223/112

[58] Field of Search ..... 223/111, 60, 75–77, 223/118, 119, 117

[56] References Cited

U.S. PATENT DOCUMENTS

| | | | |
|---|---|---|---|
| 821,049 | 5/1906 | Mason | 223/118 |
| 2,443,115 | 6/1948 | Park | 223/111 |
| 2,796,207 | 6/1957 | Young | 223/111 |
| 2,828,057 | 3/1958 | MacLauchlan | 223/111 |
| 3,231,160 | 1/1966 | Glanville | 223/111 |
| 4,066,194 | 1/1978 | Leland | 223/111 |
| 4,260,083 | 4/1981 | Aslin | 223/111 |
| 4,284,216 | 8/1981 | Leland | 223/111 |
| 4,637,532 | 1/1987 | Doorenbos | 223/111 |

FOREIGN PATENT DOCUMENTS

| | | | |
|---|---|---|---|
| 446930 | 5/1936 | United Kingdom | 223/111 |

*Primary Examiner*—Andrew M. Falik

[57] ABSTRACT

An improvement on the device disclosed in my previous U.S. Pat. No. 4,637,532 for a device for assisting in the putting on of elastic hosiery. The current invention includes the improvement of providing an expandable tip to open the stocking even wider than was possible with my previous device. The expansion is accomplished by dividing the portion over which the stocking is placed; biasing the two split parts to a normally closed position, and providing a latch to hold the device in an open position while it is in use.

11 Claims, 3 Drawing Sheets

DEVICE FOR ASSISTING IN PUTTING ON ELASTIC HOSIERY

BACKGROUND AND SUMMARY OF THE INVENTION

This invention pertains to devices to assist in the putting on of elastic hosiery and more particularly to an improvement in the device shown in my previous U.S. Pat. No. 4,637,532.

My previous patent disclosed a device over which an elastic stocking could be pulled, and which would open the stocking so that a foot and leg could be quite readily inserted. However, for some people, even the opening provided by that device was not fully sufficient particularly for initial entry of the foot into the stocking. Also for people who needed a higher pressure stocking, the narrower tongue of my new device enables the user to slip a higher pressure stocking on with less difficulty.

My current invention is an improvement over the previous device which will allow wider spreading of the opening in the stocking for even easier insertion of the foot, and will open the higher pressure hose more fully so that the stocking can be pulled on far more easily. Means is provided to hold the stocking open until the foot is fully inserted, at which time the device can be released so that the stocking can be more readily released from the assisting device.

DESCRIPTION

Figure 1:
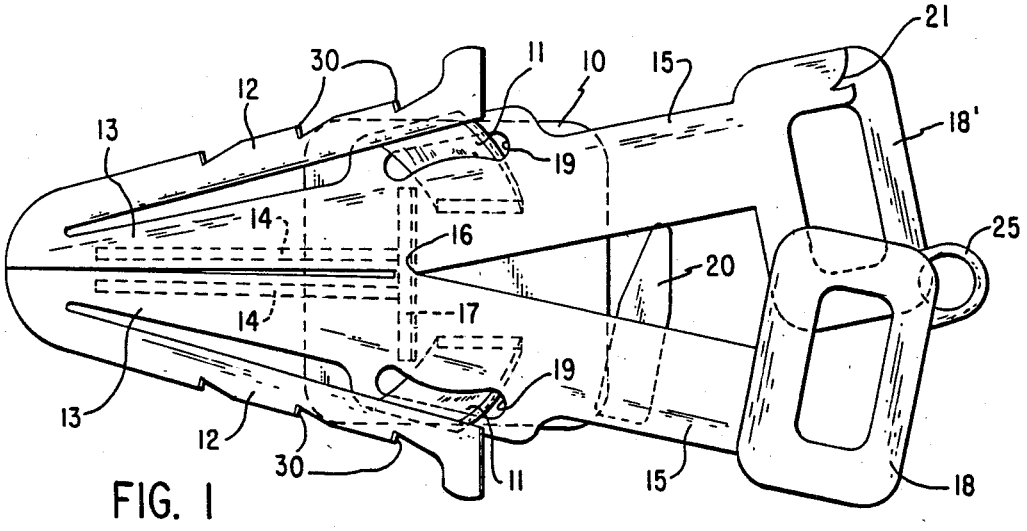
FIG. 1 is a top plan view of the improved device in the normal closed position.

Briefly, this invention comprises an improvement over the device of my previous patent including the division of the central tongue of that device into two parts which can be separated to provide for more complete opening of the elastic stocking with which the device was designed to be used, for ease of application both for the handicapped user and for the user of the higher pressure stockings.

More specifically, and referring to the drawings, I provide a base 10 and a pair of legs 11 extending upwardly therefrom in the same manner as in my original device. Side rails 12 are attached to said legs at their upper end. However where, in the original device the rails 12 ran to a central tongue, in my improved device, I provide a tongue which is split longitudinally into two tongue members 13. These tongue members 13, when joined in the normal closed position (FIG. 1) form a tongue very much like that of my original device except that it may be somewhat narrower for easier insertion into a high pressure stocking. A rib 14 on the underside of each member 13 serves to stiffen and strengthen each of the tongue members.

Each member 13 is formed with an extension 15. These extensions 15 extend from the tongue members 13 at a slightly divergent angle from each other, thereby providing a fulcrum point 16. By movement of the extensions 15 toward and away from each other, the tongue members 13 will be opened and closed about the fulcrum 16. As in my previously patented device, each extension is formed to provide an opening 19 which surrounds a leg 11.

Figure 2:
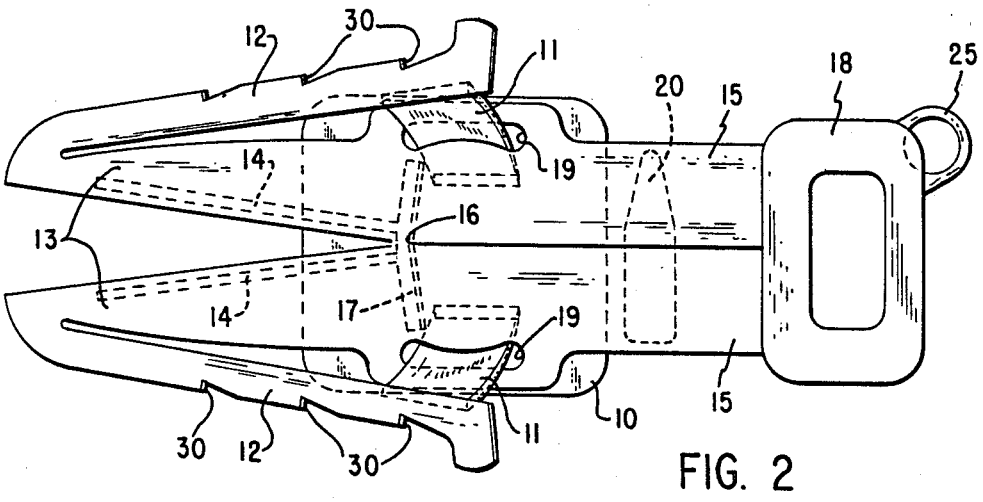
FIG. 2 is a view similar to FIG. 1 except that the device is open and latched.
Figure 3:
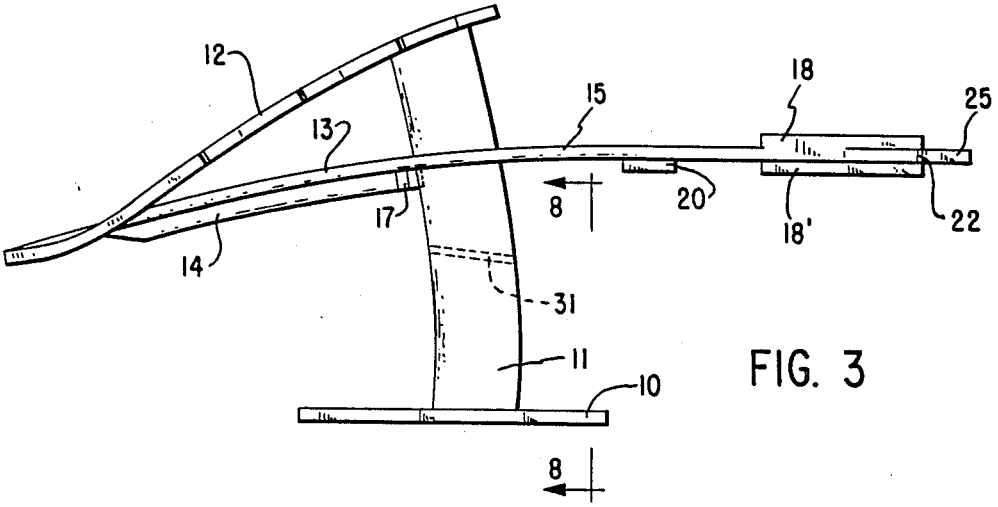
FIG. 3 is a side elevational view of the device.

In order to hold the tongue members 13 together in a normally closed position as shown in FIG. 1, I provide a transverse rib 17 extending across the fulcrum 16. This rib may be formed of metal or plastic or some other material which will act as a spring to bias the tongue members 13 toward the closed position but will allow deflection to the open position illustrated in FIG. 2. When released, the rib 17 acts as a spring means to return the tongue members 13 to the normal or closed position.

Handles 18 and 18' on each extension 15 facilitate the opening and closing movement. In order to provide overlapping handles for ease of control, I provide an upper handle 18 above the upper surface of one extension and a lower handle 18' below the lower surface of the other extension. Both extensions extend into the handle positions also, where they are formed to provide a latch means described later. This structure provides that the upper handle 18 will slide over the extension 15 on which the lower handle 18' is formed. And similarly, the lower handle 18' slides under the extension 15 on which the upper handle is formed. Thus, the structure prevents vertical movement in one direction. In order to keep the handles from displacing vertically in the opposite direction, I provide a guide 20 fixed to or formed on the extension 15 of the upper handle 18. This guide slides under the extension 15 carrying the lower handle 18' so that between the upper handle 18 and the guide 20, the extension 15 of the lower handle 18' is held in a channel formed by those elements.

Figure 4:
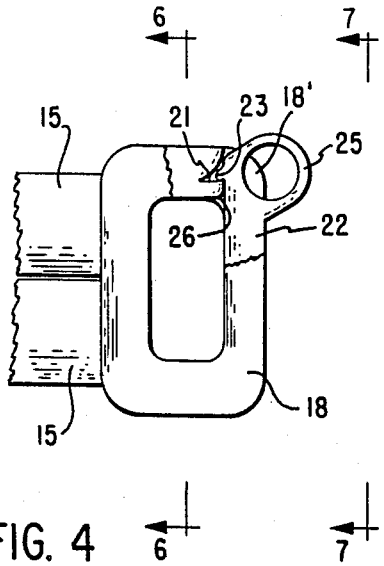
FIG. 4 is a detailed view of the handles of my device with parts being broken away to show a latching means in the latched position.
Figure 6:
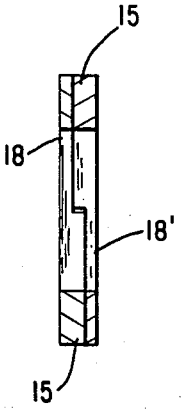
FIG. 6 is a sectional view from line 6—6 in FIG. 4.
Figure 7:
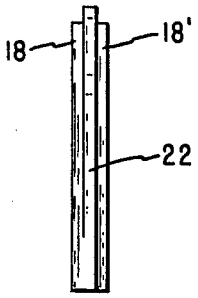
FIG. 7 is an elevational view from line 7—7 in FIG. 4.
Figure 5:
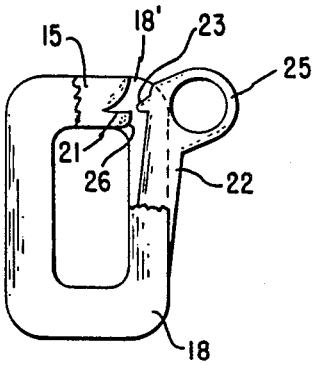
FIG. 5 is a view similar to FIG. 4 showing the latch in a released position.
Figure 9:
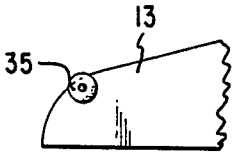
FIG. 9 is a detailed plan view of the tips of the tongue members showing an alternate form of my invention.

The latch may be formed in many ways. My preferred mode is to extend one extension 15 to form a notch 21 (FIG. 4 & 5). On the opposite extension I provide a latch arm 22 having a tooth 23 adapted to be engaged in the notch 21. The normal position of the arm 23 is fully within the perimeter of the handles 18 or 18' as shown in FIG. 4. This is true whether the tooth 23 is engaged in the notch 21 or is completely free of the notch. However, I provide a ring 25 on the latch arm 22 so that the tooth can be pulled free (FIG. 5) and the latch thereby released. Thus, when the handles are moved toward each other, the surface of the tooth 23 will normally engage a sloping surface 26 near the notch 21. The latch arm 22 will be displaced slightly, and on further motion the tooth 23 will drop into the notch 21 and the latch will be engaged. This results in the tongue members 13 being held in the open position shown in FIG. 2. Pulling the ring 25 will disengage the tooth 21 from the notch 23 thus releasing the latch and allowing the spring rib 17 to return the tongue members 13 to the normal closed position of FIG. 1.

The use of the device is very similar to that of my previously patented device. An elastic stocking is pulled over the outer rails 12 when the tongue members 13 are in their closed position. This position also pulls the rails as close together as possible. The stocking is partially held by the notches 30 on the outer edges of the rails 12 in the same manner as in my previous device.

When the stocking is in place, the handles 18 and 18' are pulled together against the tension of the stocking until the latch arrangement is engaged by the tooth 23 falling into the notch 21. At that point, the stocking will be spread to its widest in a lateral direction.

The extensions 15 are then pressed downwardly either by hand or by foot pressure until one edge of the opening 19 engages the notches 31 formed on the inward facing surfaces of the legs 11. This function and structure are also common to this device and its predecessor. In this position, the stocking is fully spread both laterally and vertically. It will then be easy to insert a foot into the stocking. The foot and leg are nearly fully inserted into the stocking in a manner similar to the use of a shoe horn. Either the device is then withdrawn from the stocking, or, the ring 25 may be pulled to release the latch device and allow the tongue members to resume their normal position, thus allowing the stocking partially to be relaxed. Then, the legs 11 may be spread slightly releasing the extensions 15 from the notches 30 allowing the additional relaxing of the opened stocking. If not withdrawn before, the entire device can then be withdrawn and the stocking may be adjusted as desired. If the device is withdrawn while the legs and tongue members are still opened, they can be released by the same process earlier described.

In some instances, the pulling on or removal of the hosiery from the device may be too difficult for some users. In that event, I would provide that small rollers 35 be mounted near the tips of the tongue members 13 where the stocking would first contact the tongue member. Normally this would be near the juncture between the tongue members 13 and the side rails 12. These rollers extend slightly beyond the outer edge of the tips and will rotate as the stocking is pulled past them so as to reduce the friction between the stocking and that part of the device.

Figure 10:
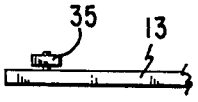
FIG. 10 is a side elevational view of the embodiment of FIG. 9.
Figure 8:
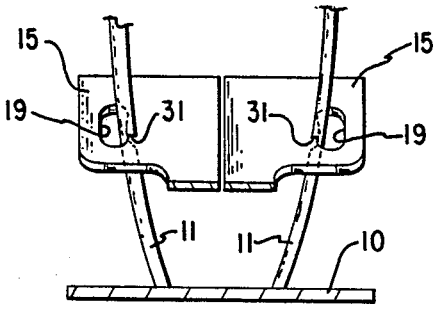
FIG. 8 is an elevational view from line 8—8 in FIG. 3.
Figure 11:
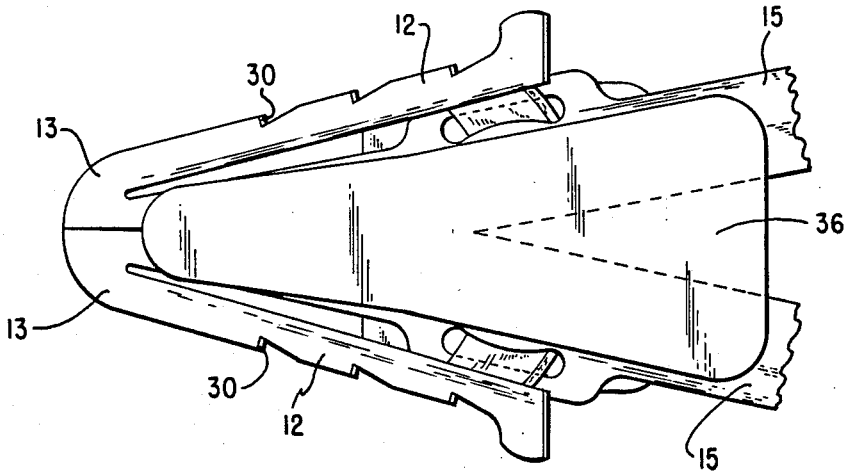
FIG. 11 is a detailed partial plan view of my device showing an alternate shield.
Figure 12:
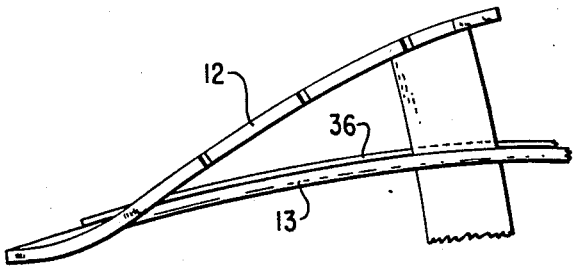
FIG. 12 is a side elevational view of the device of FIG. 11.

I also conceive that there may be for some users, fear of pinching the sole of the foot. Therefore, I suggest that a sole plate 36 (FIGS. 10 and 11) be fastened to one of the tongue members 13 and extend over the opposite tongue member. Thus the members 13 would be free to move toward and away from each other while the plate 36 would guard the sole of the user's foot from being pinched, tickled or the like.

Thus I have provided an improved device similar to my previously patented device. In the improved device I provide for a lateral spreading of the elastic stocking as well as the vertical spreading provided by the original.

I claim as my invention:

1. A device for assisting in the putting on of elastic hosiery by opening the hosiery for the insertion of a user's foot comprising rail means adapted to be inserted into said hosiery, tongue means resiliently attached to said rail means adapted normally to lie in a nearly planar relationship, said tongue means being divided into two members lying together in a normally closed position, said members being movable apart form each other to provide an open position in which said tongue members force said rail members to move apart laterally, said tongue members also being movable vertically out of said planar relationship with the rail means whereby said hosiery will be opened both laterally by separation of said tongue members and vertically by movement of said tongue members relative to said rail means, and means to hold said tongue members in their position whereby the hosiery disposed over said rail means will be held open for insertion of the user's foot.

2. The device of claim 1 in which the means to hold said tongue members displaced from their planar relationship with said rail means includes a base, legs on said base holding said rail means and slidably engaged with said tongue members and means formed on said legs engageable with a portion of said tongue members adapted to hold said tongue members releasably out of said planar relationship with said rail means.

3. The device of claim 1 in which said tongue members in the closed position are formed to provide a rounded end, each of said tongue members including an extension opposite said rounded end, said extensions diverging from each other, thus providing a fulcrum at their meeting point whereby motion to being said extensions together cause separation of the ends of said tongue members.

4. The device of claim 3 in which means on said extensions are engageable to hold said extensions releasably together, whereby said tongue members are releasably held in their open position.

5. The device of claim 3 in which resilient means is engaged with said tongue members to bias said tongue members to the closed position.

6. The device of claim 5 in which said resilient means comprises a resilient rib fixed to and extending at least partially across both of said tongue members.

7. The device of claim 4 in which said extensions are formed to provide handles at their extremities to assist in moving said tongue members to said open position.

8. The device of claim 6 in which said handles are formed with latch means engageable between said handles, said latch means being adapted to be engaged to hold said handles releasable in the position causing the tongue members to be in the open position.

9. The device of claim 6 in which at least one of said handles on an extension complements guide means on the same extension to form channel means whereby the other of said extensions is guided to an abutting relation with said first named extension.

10. The device of claim 3 in which roller means are rotatably mounted on each of said tongue members near the junction with said rail means.

11. The device of claim 3 in which a sole plate is fixed to one of said tongue members and extends above said tongue members for the protection of said user's foot.

* * * * *